United States Patent [19]

Wyslotsky

[11] 3,983,994

[45] Oct. 5, 1976

[54] FLEXIBLE PACKAGE

[76] Inventor: Ihor Wyslotsky, 3311 Montmarte Ave., Hazel Crest, Ill. 60429

[22] Filed: Jan. 29, 1975

[21] Appl. No.: 544,880

[52] U.S. Cl. ..... 206/219; 206/484; 206/498; 229/66

[51] Int. Cl.[2] ..... B65D 75/30; B65D 65/30; B65D 65/32

[58] Field of Search ..... 206/498, 484, 219; 229/66

[56] References Cited

UNITED STATES PATENTS

| | | | |
|---|---|---|---|
| 2,512,367 | 6/1950 | Nicolle | 206/484 |
| 2,916,197 | 12/1959 | Detrie et al. | 206/219 |
| 3,156,352 | 11/1964 | Hayhurst | 206/219 |
| 3,256,981 | 6/1966 | Kurtz | 229/48 T |
| 3,301,390 | 1/1967 | Via, Jr. | 206/219 |
| 3,685,645 | 8/1972 | Kawaguchi | 206/498 |
| 3,744,625 | 7/1973 | Chin | 206/219 |
| 3,768,725 | 10/1973 | Pilaro | 206/484 |

*Primary Examiner*—William T. Dixson, Jr.
*Assistant Examiner*—Allan N. Shoap
*Attorney, Agent, or Firm*—Paul H. Gallagher

[57] ABSTRACT

A flexible package or pouch including a pair of opposed sheets sealed together around their peripheral edges, forming a closed interior and sealed together along an intermediate septum line between the ends to form a pair of chambers or pockets; separate materials are contained in the respective chambers, for later mixing; tabs are provided on the sheets for grasping by the user, and in response to pulling outwardly of the tabs, the septum line of sealing is broken, establishing communication between the chambers, enabling mixing of the materials.

1 Claim, 11 Drawing Figures

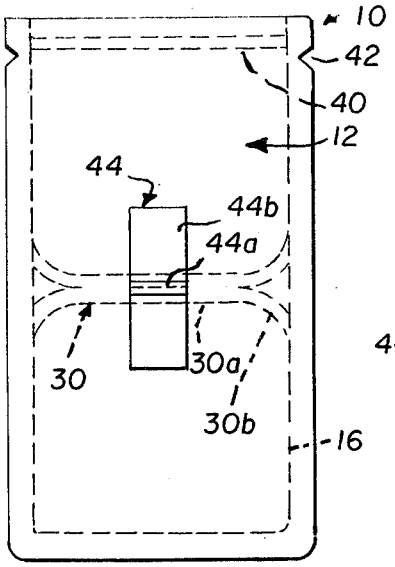
FIG. 1
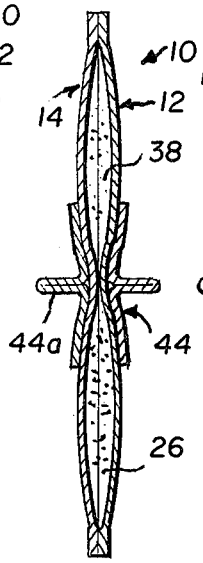
FIG. 3
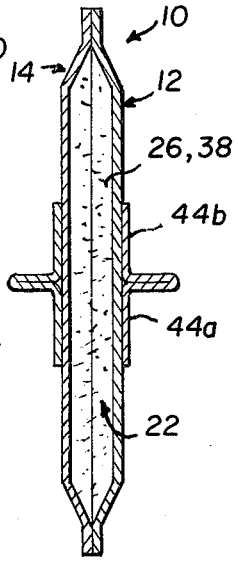
FIG. 4
FIG. 2
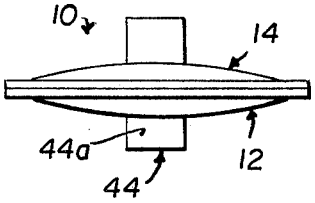
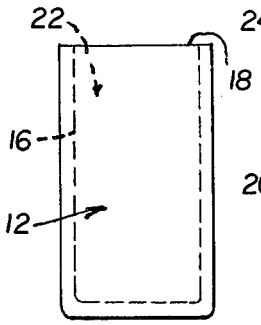
FIG. 5a
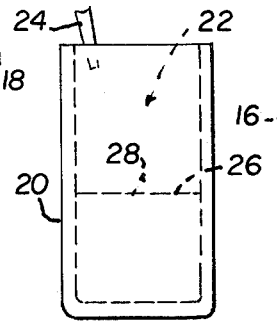
FIG. 5b
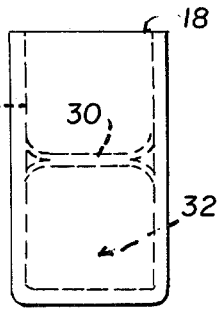
FIG. 5c
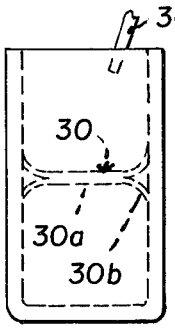
FIG. 5d
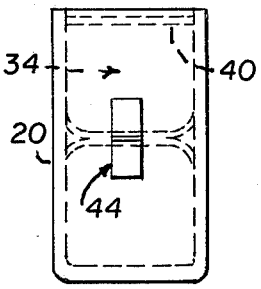
FIG. 5e
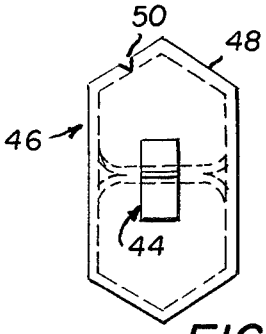
FIG. 6
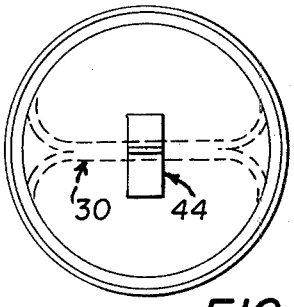
FIG. 7

FLEXIBLE PACKAGE

OBJECTS OF THE INVENTION

A broad object of the invention is to provide a flexible package including different components or materials to be mixed, but confining the materials in different chambers divided by a septum line of sealing, and enabling that line of sealing to be separated or broken, forming a single large pocket in which the materials can then be intermixed.

The device of the invention is particularly useful in mixing materials that must be accurately measured, and are mixed at a point of use. For example, previously it was necessary, or at least the custom, to provide different materials individually, and at the point of use the user would select portions of the materials according to individual judgment and then mix them. The human error was quite high, not only in determining the amounts of the materials, but the manner of mixing them also enabled a certain degree of error to be introduced. The device is additionally advantageous in mixing materials which must be maintained within a high degree of purity and without contamination or undue exposure to outside influences.

Another and broad object of the invention therefore is to provide a package containing materials to be later intermixed, but which is of such character as to overcome the disadvantages noted above.

Still another object is to provide a package of the foregoing general nature, of flexible construction and in which the materials or components to be mixed are accurately measured in introducing them into the package, and they can be effectively mixed at the point of use without the necessity for unusual skill.

Still another object is to provide a package of the foregoing general nature which is extremely efficient because the amounts of materials to be utilized in the mixing operation are no more than necessary for the purpose intended, thereby eliminating provision of excessive materials and correspondingly eliminating waste.

A still further object is to provide a package of the foregoing general character which because of the separation of the materials which are to be later mixed, the package has an extremely long shelf life, and from a practical standpoint an indefinite shelf life.

An additional object is to provide a package of the foregoing character which is relatively small and compact, and it is at least partially of transparent material whereby the user can visually observe the intermixing operation, when the intermixing is to be done at the point of use.

A further object is to provide a package of the foregoing kind, which is very compact, and renders the use thereof highly efficient in transporting packages which may be done in any smaller or larger degree, according to the immediate need, thereby eliminating transporting of bulk materials to be mixed.

Another object is to provide a package of the kind referred to above, having different chambers containing the materials to be later mixed, having high barrier characteristics between the chambers.

An additional object is to provide a novel method of mixing materials of the character indicated by the device referred to above.

DESCRIPTION OF A PREFERRED EMBODIMENT:

In the drawings:

FIG. 1 is a face view of a flexible package made according to the present invention;

FIG. 2 is a top view of the package;

FIG. 3 is a longitudinal sectional view of the package of FIGS. 1 and 2 in its complete form, that is, with the different materials therein separated from each other;

FIG. 4 is a sectional view oriented according to FIG. 3 but with the septum line of sealing broken or separated, forming a single large pocket therein and with the materials in mixed condition;

FIGS. *5a–5e* is a semi-diagrammatic view showing different steps in the operation of filling the container of the package, to form the completed package;

FIG. 6 is a face view of a slightly modified form of package; and

FIG. 7 is a face view of another slightly modified form of package.

Referring in detail to the accompanying drawings, attention is directed first to FIGS. 1 and 2 showing the completed package. These figures show the package in its final form, but the order of the steps in producing the package is of significance in connection with the condition of the completed package, as will be described hereinbelow particularly in connection with FIGS. *5a–5e*.

The completed package or pouch is indicated in its entirety at 10 and includes a pair of opposed members 12, 14 of congruent outline shape. These members, in the form of sheets, are flexible and preferably of plastic material and capable of being sealed together, under the influence of pressure and/or heat, or otherwise, to form a secure seal against the escape of the materials contained in the package and to be mixed. Sheet material identified as 3M Co's No. 609A is suitable for the purpose, and the sheets may be transparent or opaque, as desired, or for example, one may be transparent and the other opaque. It is also within the concept of the invention that one of the sheets is more rigid than the other to form a semi-rigid package for ease in handling, particularly in packing the packages for shipment or for use in other steps in making and filling it.

In an early stage of the formation of the package, the two sheets 12, 14 are fitted together and sealed around three sides of their periphery as indicated at 16, but on the fourth side they are not sealed, leaving an opening 18 between the sheets at that location. For convenience the two sheets together form what will be referred to as a container and indicated at 20, the container with the contents therein later being referred to as the package. The two sheets when secured together as just referred to, form an interior space 22 which may be also referred to as a large pocket, as again referred to hereinbelow.

The line of sealing 16 is non-peelable, that is, the sealing is permanent in the practical use of the package, this kind of sealing being known in the trade.

After the two sheets 12, 14 are secured together on the three sides as referred to, the first step in the filling operation is performed, and attention is directed to FIG. *5b* for this purpose. A spout 24 diagrammatically representing filling means is introduced through the opening 18 and a quantity of a first material to be used in the mixing operation is introduced into the container. In the present instance that first material may be distilled water, as indicated at 26, in an amount as to only partially fill the container, such as one-half or less, the line 28 indicating the level of the water (see also FIG. 3).

After the first material, or water, is introduced into the container, the two sheets or members of the container are sealed together along a septum sealing line 30 forming a first chamber 32 confining the water. The septum line of sealing 30 is of peelable character, which as referred to hereinbelow will be broken without breaking the permanent or non-peelable sealing line 16 at the periphery. Preferably this septum seal has a center common portion 30*a* and forked ends forming outwardly diverging arms 30*b*, so that the line of sealing forms in effect two portions arcuate about axes respectively in the chamber 32 and the counterpart chamber 34 to be later formed and as referred to hereinbelow. The non-peelable line 16 may be of such character as relative to the peelable line 30. The peelable kind of sealing is also well known in the trade and need not be further described.

In the next step of forming the package a second material is introduced into the interior of the container by suitable means indicated diagrammatically by a spout 36. This material may be a powder, as referred to again hereinbelow, this material being shown at 38 in FIG. 3.

After the second material, or powder, is so introduced, the sheets are sealed together along a line 40, closing the opening 18 of the container and forming the chamber 34 identified above, confining the second material. The sealing line 40 is of non-peelable nature, and of permanent character from a practical standpoint similarly to the line 16.

The container is notched as indicated at 42 to facilitate opening the package after the mixing operation is performed. This notching may conveniently be done after the container is filled and sealed. The user when he desires to open the package tears the end of the package off, along a line between the notches.

The final element of the completed package includes a pair of pull tabs 44, and these are applied preferably after forming the septum line of sealing 30, and they may be applied before or after filling the chamber 38 and forming the final seal 40, the latter step being considered in conjunction with handling of the package in commercial operations. The pull tabs 44 may be of any suitable material, such a plastic material, and each includes an outstanding tab element 44*a*, and wings 44*b*. These tabs are for the purpose of breaking the septum seal line 30 and are secured to the exterior surfaces of the sheets 12, 14, in a center location in register with the septum seal line. The wings 44*b* may be secured by any suitable means such as an adhesive material, and the tab elements 44*a* extend generally outwardly from the sides of the package.

At the point of use the user grasps the tabs 44 and pulls them outwardly, this breaking the septum seal line 30, establishing communication between the chambers 32, 34, forming a single large pocket and enabling the materials in those chambers to intermix, forming what is known as a substrate.

The forked ends 30*b* of the septum seal line form an acute angle to the side edges of the container and thus when the user pulls the tabs, the force applied thereto does not reach such a degree at the edges of the container as would be the case if that line were perpendicular to the side edges, at the points of juncture, thus minimizing any accidental breaking of the peripheral seal 16 at those locations.

The material 38, or powder, can be any of a wide variety of materials, but as an example thereof in an effective use of the device it may be a chemical reagent. It may be a single material, or a mixture of various materials. When the septum line is broken, the other material 26, such as water, mixes with the powder or chemical reagent in the exact proportions desired. Heretofore in making such mixtures or substrates, the materials were measured often by personal judgment on the spot, or even if they were measured accurately in special containers, the materials were supplied in bulk, and this constituted quite a disadvantage. For example, the bulk materials must be exposed and this could on occasion impair the quality thereof. Additionally producing the mixture in a separate container exposed the materials, or the mixture, to atmosphere and possible impairment or contamination.

In the present instance the materials may be introduced into the container under conditions that are more easily controlled, that is, for example the distilled water is introduced and then the container sealed and that water is not exposed to any other influence other than in the mixing step. Similarly the powder or second material introduced into the chamber 34 is so introduced under controlled conditions and then that chamber sealed. The mixing step is then performed without either of the materials being exposed to any outside influence.

Another great advantage of the invention is that the final package can be easily shipped or transported. Packages may be completed at one location and then shipped as such complete packages, but another distinct advantage is that it may be desired to introduce one of the materials, such as the distilled water, and then ship the so semi-completed package to another manufacturer or filler, who can then introduce the second material and perform the step of sealing the open end of the package at the line 40.

The completed package, with the different materials sealed therein has a long shelf life because of the isolation of the materials from the exterior.

The mixing step does not require any unusual skill, but an ordinary worker can simply pull the tabs 44 and the mixing step is thereby performed. In the mixing step the package may be shaken to speed up the mixing operation. Also the package may be held with either end down, being inverted if so desired. The package is very compact, particularly in that it contains only the exact amounts of the materials desired.

Referring to the modified forms of FIGS. 6 and 7, the package 46 of FIG. 6 instead of having straight ends, is provided with tapered or pointed ends as indicated at 48, and at one end a tearing or ripping notch 50 may be provided.

FIG. 7 shows an overall round shape as viewed when oriented according to FIGS. 5*a*–5*e*. The forms of FIGS. 6 and 7 provide constructions that are of unusual strength, and which are very effective for balancing the forces involved. The constructions of FIGS. 6 and 7 include the separate chambers and the peelable septum line of sealing between those chambers, in common with the form of the previous figures.

I claim:

1. A package comprising, a pair of separate opposed sheets of congruent outline shape fitted together in face-to-face relation and interengaging except for materials therebetween in certain areas as specified hereinbelow, the sheets being sealed together in face-to-face interengagement along a non-peelable line extending around the periphery of the package, the sheets also being sealed together in face-to-face interengagement along a septum line extending across the package at a mid-portion of the package and interconnecting at its ends with opposed elements of the periphery sealing line at the edges of the package, the septum line forming chambers respectively on opposite sides thereof and the package containing said materials in the respective chambers for intermixing, the septum sealing line upon being peeled eliminating barrier between the chambers and forming a single large pocket enabling intermixing of the materials, the mid-portions of the opposed sheets being effectively interengaged in flat relation at said septum line, the septum line including a central single linear portion and a pair of curved elements at each end diverging longitudinally outwardly and interconnecting with the respective elements of the periphery line at acute angles to the latter and constituting the elements by which the septum sealing line interconnects with the periphery sealing line, the curved elements of the septum sealing line facilitating peeling action of the latter, wherein the force utilizing in peeling the septum sealing line at the central portion of the package is propagated through the curved elements fully to the periphery sealing line, all elements of the septum sealing line lying in a common plane between the sheets.

* * * * *